US005697843A

United States Patent [19]

Manship et al.

[11] Patent Number: 5,697,843

[45] Date of Patent: *Dec. 16, 1997

[54] VIDEO GAMING MACHINE

[75] Inventors: Jon Manship, Moncton; Michel Vinneau, Dieppe; David Ross, Moncton; Nathalie Haché; Charles Maillet, both of Bouctouche, all of Canada

[73] Assignee: Spielo Gaming International, Canada

[ * ] Notice: The term of this patent shall not extend beyond the expiration date of Pat. No. 5,393,061.

[21] Appl. No.: 361,726

[22] Filed: Dec. 23, 1994

Related U.S. Application Data

[63] Continuation of Ser. No. 992,962, Dec. 16, 1992, Pat. No. 5,393,061.

[51] Int. Cl.[6] ..... G07F 17/34

[52] U.S. Cl. ..... 463/20; 273/143 R

[58] Field of Search ..... 273/138 A, 143 R; 463/20, 25

[56] References Cited

U.S. PATENT DOCUMENTS

| | | | |
|---|---|---|---|
| Re. 34,244 | 5/1993 | Hagiwara | 463/20 |
| 3,834,712 | 9/1974 | Cox | 273/143 R |
| 4,508,345 | 4/1985 | Okada | 273/143 R |
| 4,517,558 | 5/1985 | Davids | 345/113 |

(List continued on next page.)

FOREIGN PATENT DOCUMENTS

| | | |
|---|---|---|
| 2036472 | 8/1991 | Canada . |
| 90192 | 12/1977 | Japan . |
| 24556 | 2/1981 | Japan . |
| 1184 | 6/1981 | Japan . |

(List continued on next page.)

OTHER PUBLICATIONS

Ocean to Ocean, Game Machine, No. 157, Jan. 1–15, 1981, p. 25. Translation included.

Raven Continental Brochure and Translation Translation included.

Disclosure of Wing Lucky 8–Line W–4 Video Game, Wing Lucky 8–Line W–6 Video Game, and Lucky 8–Line video Game.

*Primary Examiner*—Benjamin H. Layno

*Attorney, Agent, or Firm*—Jefferson Perkins

[57] ABSTRACT

A video slot machine includes a display screen on which the wheels of a slot machine are simulated. The display screen is divided into an army of cells with each cell displaying an individual game element selected randomly from a group of available game elements during a game play. Pay-out lines are associated with the rows, columns and diagonals of the array of cells and visually indicate some of the pre-determined sets of cells which are examined to detect winning combinations of displayed game elements. Pay-out tables are stored in memory within the machine and hold information concerning combinations of elements in all of the pre-determined sets of cells which result in a win when displayed on the screen and the amount to be paid for each win. When the game is played and the screen displays a randomly selected game element in each of its cells, the machine consults each of the pay-out tables to determine if the game elements as displayed in the cells result in a winning combination of elements as stored in the pay-out tables and calculates the amount to be paid. Therefore, depending on the elements displayed in the army of cells, winnings from more than one pay-out table may result. The winning combinations of elements, the pre-determined sets of cells, the number of available elements and the amount paid for each winning combination of displayed elements are selected so that the expected return of the video slot machine complies with regulatory restrictions while still ensuring that the game is dynamic and appealing to a player.

29 Claims, 6 Drawing Sheets

U.S. PATENT DOCUMENTS

| | | | |
|---|---|---|---|
| 4,522,399 | 6/1985 | Nishikawa | 273/143 R |
| 4,570,934 | 2/1986 | Smyth | 273/143 R |
| 4,618,150 | 10/1986 | Kimura | 273/143 R |
| 4,648,600 | 3/1987 | Olliges | 463/20 |
| 4,652,998 | 3/1987 | Koza et al. | 463/26 |
| 4,657,256 | 4/1987 | Okada | 273/143 R |
| 4,669,731 | 6/1987 | Clarke | 273/143 R |
| 4,679,143 | 7/1987 | Hagiwara | 463/25 |
| 4,695,053 | 9/1987 | Vazquez, Jr. et al. | 273/143 R |
| 4,715,604 | 12/1987 | Okada | 273/143 R |
| 4,721,307 | 1/1988 | Okada | 273/143 R |
| 4,795,155 | 1/1989 | Grande | 273/143 R |
| 4,826,169 | 5/1989 | Bessho et al. | 273/143 R |
| 4,838,552 | 6/1989 | Hagiwara | 463/20 |
| 4,874,173 | 10/1989 | Kishishita | 273/143 R |
| 4,991,848 | 2/1991 | Greenwood et al. | 273/143 R |
| 5,024,439 | 6/1991 | Okada | 273/143 R |
| 5,048,833 | 9/1991 | Lamle | 463/27 |
| 5,050,881 | 9/1991 | Nagao | 273/143 R |
| 5,067,712 | 11/1991 | Georgilas | 273/143 R |
| 5,083,785 | 1/1992 | Okada | 273/143 R |
| 5,123,649 | 6/1992 | Tiberio | 273/143 R |
| 5,135,224 | 8/1992 | Yamamoto et al. | 273/143 R |
| 5,209,479 | 5/1993 | Nagao et al. | 273/143 R |
| 5,342,047 | 8/1994 | Heidel et al. | 463/29 |
| 5,375,830 | 12/1994 | Takemoto et al. | 273/143 R |
| 5,423,539 | 6/1995 | Nagao | 273/143 R |
| 5,423,541 | 6/1995 | Nicastro et al. | 273/143 R |
| 5,449,173 | 9/1995 | Thomas et al. | 273/143 R |

FOREIGN PATENT DOCUMENTS

| | | |
|---|---|---|
| 75981 | 11/1981 | Japan . |
| 131469 | 2/1982 | Japan . |
| 1466765 | 3/1977 | United Kingdom . |
| 2083935 | 3/1982 | United Kingdom . |
| 2098778 | 11/1982 | United Kingdom . |
| 2106682 | 4/1983 | United Kingdom . |

34

| RN | ELEMENT |
|---|---|
| 1 | ORANGE |
| 2 | PLUM |
| 3 | SEVEN |
| 4 | MELON |
| 5 | BELL |
| 6 | ORANGE |
| 7 | SEVEN |
| 8 | SINGLE BAR |
| 9 | BELL |
| 10 | DOUBLE BAR |
| 11 | ORANGE |
| 12 | SEVEN |
| 13 | BELL |
| 14 | MELON |
| 15 | PLUM |
| 16 | CHERRY |
| 17 | TRIPLE BAR |
| 18 | ORANGE |
| 19 | DOUBLE BAR |
| 20 | PLUM |
| 21 | SEVEN |
| 22 | ORANGE |
| 23 | BELL |
| 24 | SINGLE BAR |

50

60

| CODE | NORMAL ODDS | | | PAY |
|---|---|---|---|---|
| 3 | BAR | BAR | BAR | X50 |
| 2 | BAR | BAR | BAR | X25 |
| 1 | BAR | BAR | BAR | X15 |
| 8 | | | | X12 |
| 4 | | | | X10 |
| 7 | 7 | 7 | 7 | X10 |
| 9 | | | | X8 |
| 5 | | | | X5 |
| 10 | ANY BAR | ANY BAR | ANY BAR | X5 |
| 6 | | | | X5 |
| 11 | | | — | X3 |
| 12 | | — | — | X1 |

*FIG. 4A*

62

| CODE | SPECIAL ODDS | PAY |
|---|---|---|
| 3 | ALL BAR | X150 |
| 2 | ALL BAR | X120 |
| 6 | ALL | X110 |
| 1 | ALL BAR | X100 |
| 8 | ALL | X90 |
| 4 | ALL | X80 |
| 9 | ALL | X70 |
| 5 | ALL | X60 |
| 10 | ALL ANY BAR | X50 |
| 7 | 4 CORNERS | X10 |

*FIG. 4B*

50

64

| CODE | SEVEN ODDS | PAYS |
|---|---|---|
| 9 | ALL 9 7 | X380 |
| 8 | ALL 8 7 | X200 |
| 7 | ALL 7 7 | X100 |
| 6 | ALL 6 7 | X20 |
| 5 | ALL 5 7 | X10 |
| 4 | ALL 4 7 | X5 |
| 3 | ALL 3 7 | X2 |
| 2 | ALL 2 7 | X0 |
| 1 | ALL FRUIT | X20 +POT |

*FIG. 4C*

68

| CODE | BELL ODDS | PAYS |
|---|---|---|
| 9 | ALL 9 | X100 |
| 8 | ALL 8 | X90 |
| 7 | ALL 7 | X80 |
| 6 | ALL 6 | X70 |
| 5 | ALL 5 | X60 |
| 4 | ALL 4 | X50 |
| 3 | ALL 3 | X40 |
| 2 | ALL 2 | X30 |
| 1 | ALL 1 | X20 |

*FIG. 4D*

66

| CODE | POT ODDS | PAY |
|---|---|---|
| 9 | ALL 9 BAR | X100 |
| 8 | ALL 8 BAR | X80 |
| 7 | ALL 7 BAR | X50 |
| 6 | ALL 6 BAR | X20 |
| 5 | ALL 5 BAR | X10 |
| 4 | ALL 4 BAR | X3 |
| 3 | ALL 3 BAR | X2 |
| 2 | ALL 2 BAR | X0 |
| 1 | ALL 1 BAR | X0 |

*FIG. 4E*

NORMAL ODDS

| LEFT | MIDDLE | RIGHT | L | M | R | | PROB. | PAY OFF | EXPECTED RETURN | |
|---|---|---|---|---|---|---|---|---|---|---|
| OTHERS | OTHERS | OTHERS | 24 | 24 | 24 | 13824 | | | | |
| 7 | 7 | 7 | 4 | 4 | 4 | 64 | 4.63E-03 | 10 | 4.63E-02 | |
| 1 BAR | 1 BAR | 1 BAR | 2 | 2 | 2 | 8 | 5.79E-04 | 15 | 8.68E-03 | |
| 2 BARS | 2 BARS | 2 BARS | 2 | 2 | 2 | 8 | 5.79E-04 | 25 | 1.45E-02 | |
| 3 BARS | 3 BARS | 3 BARS | 1 | 1 | 1 | 1 | 7.23E-05 | 50 | 3.62E-03 | |
| BELL | BELL | BELL | 4 | 4 | 4 | 64 | 4.63E-03 | 10 | 4.63E-02 | |
| ORANGE | ORANGE | ORANGE | 5 | 5 | 5 | 125 | 9.04E-03 | 5 | 4.52E-02 | |
| CHERRY | CHERRY | CHERRY | 1 | 1 | 1 | 1 | 7.23E-05 | 5 | 3.62E-04 | |
| MELON | MELON | MELON | 2 | 2 | 2 | 8 | 5.79E-04 | 12 | 6.94E-03 | |
| PLUM | PLUM | PLUM | 3 | 3 | 3 | 27 | 1.95E-03 | 8 | 1.56E-02 | |
| ANY BAR | ANY BAR | ANY BAR | 5 | 5 | 5 | 108 | 7.81E-03 | 5 | 3.91E-02 | |
| CHERRY | CHERRY | | 1 | 1 | 23 | 23 | 1.66E-03 | 3 | 4.99E-03 | |
| CHERRY | | | 1 | 23 | 24 | 552 | 3.99E-02 | 1 | 3.99E-02 | |
| | | | | | | | | | 0.271484 | 0.27148 |

*FIG. 6A*

SPECIAL ODDS

| | | | | | | |
|---|---|---|---|---|---|---|
| ANYTHING | 24 | 2.6E+12 | | | | |
| 1 BAR | 2 | 512 | 1.94E-10 | 100 | 1.94E-08 | |
| 2 BARS | 2 | 512 | 1.94E-10 | 120 | 2.33E-08 | |
| 3 BARS | 1 | 1 | 3.79E-13 | 150 | 5.68E-11 | |
| BELL | 4 | 262144 | 9.92E-08 | 80 | 7.94E-06 | |
| ORANGE | 5 | 1953125 | 7.39E-07 | 60 | 4.44E-05 | |
| CHERRY | 1 | 1 | 3.79E-13 | 110 | 4.16E-11 | |
| MELON | 2 | 512 | 1.94E-10 | 90 | 1.74E-08 | |
| PLUM | 3 | 19683 | 7.45E-09 | 70 | 5.22E-07 | |
| ANY BAR | 5 | 1953120 | 7.39E-07 | 50 | 3.7E-05 | |
| | | | | | 8.98E-05 | 9E-05 |

*FIG. 6B*

4 CORNERS

| | | | | | | |
|---|---|---|---|---|---|---|
| ANYTHING | 24 | 331776 | | | | |
| 1 BAR | 2 | 16 | 4.82E-05 | 10 | 0.000482 | |
| 2 BARS | 2 | 16 | 4.82E-05 | 10 | 0.000482 | |
| 3 BARS | 1 | 1 | 3.01E-06 | 10 | 3.01E-05 | |
| BELL | 4 | 256 | 7.72E-04 | 10 | 0.007715 | |
| ORANGE | 5 | 625 | 1.88E-03 | 10 | 0.018831 | |
| CHERRY | 1 | 1 | 3.01E-06 | 10 | 3.01E-05 | |
| MELON | 2 | 16 | 4.82E-05 | 10 | 0.000482 | |
| PLUM | 3 | 81 | 2.44E-04 | 10 | 0.002441 | |
| 7 | 4 | 256 | 7.72E-04 | 10 | 0.007715 | |
| | | | | | 0.038209 | 0.03821 |

*FIG. 6C*

| | | | | | |
|---|---|---|---|---|---|
| SEVEN ODDS | | | | | |
| | | | | 400 | |
| 9 | | | 9.92E-08 | 380 | 3.77E-05 |
| 8 | | | 4.47E-06 | 200 | 8.93E-04 |
| 7 | | | 8.93E-05 | 100 | 8.93E-03 |
| 6 | | | 1.04E-03 | 20 | 2.08E-02 |
| 5 | | | 7.81E-02 | 10 | 7.81E-02 |
| 4 | | | 3.91E-02 | 5 | 1.95E-01 |
| 3 | | | 1.30E-01 | 2 | 2.60E-01 |
| 2 | | | 2.79E-01 | 0 | 0 |
| | | | | | 0.564676 | 0.56468 |

*FIG. 6D*

| | | | | | | |
|---|---|---|---|---|---|---|
| ALL FRUITS | | | | | | |
| | | | 2.6E+12 | | | |
| | | 11 | 2.4E+09 | 8.9E-04 | 20 | 0.017851 | 0.01785 |

*FIG. 6E*

| | | | | | | | |
|---|---|---|---|---|---|---|---|
| BELLS ODDS | | GAMES | | | | | |
| ANYTHING | | 24 | | 7962624 | | 25.5 | |
| BELL+ | 0.1667 | 4 | 9 | 1024 | 1.29E-04 | 1 | |
| 1 BELL | 1 | 1 | | 0.34885 | 4.04E-04 | 20 | 0.008075 |
| 2 BELLS | 2 | 2 | | 0.27908 | 3.23E-04 | 30 | 0.00969 |
| 3 BELLS | 3 | 3 | | 0.13024 | 1.51E-04 | 40 | 0.00603 |
| 4 BELLS | 4 | 4 | | 0.03907 | 4.52E-05 | 50 | 0.002261 |
| 5 BELLS | 5 | 5 | | 0.00781 | 9.04E-06 | 60 | 0.000543 |
| 6 BELLS | 6 | 6 | | 0.00104 | 1.21E-06 | 70 | 8.44E-05 |
| 7 BELLS | 7 | 7 | | 8.9E-05 | 1.03E-07 | 80 | 8.27E-06 |
| 8 BELLS | 8 | 8 | | 4.5E-06 | 5.17E-09 | 90 | 4.65E-07 |
| 9 BELLS | 9 | 9 | | 9.9E-08 | 1.15E-10 | 100 | 1.15E-08 |
| | | | | | | | 0.026692 | 0.02669 |

*FIG. 6F*

| | | | | | | | |
|---|---|---|---|---|---|---|---|
| POT ODDS | | | | | | | |
| ANYTHING | | 24 | | 2.6E+12 | ALL FRUIT | | |
| 3 BARS | 0.0417 | 1 | | 1 | 8.93E-04 | 1 | |
| 1 TIME | 1 | 1 | | 0.26679 | 2.38E-04 | 0 | 0 |
| 2 TIMES | 2 | 2 | | 0.0464 | 4.14E-05 | 0 | 0 |
| 3 TIMES | 3 | 3 | | 0.00471 | 4.20E-06 | 2 | 0.009414 |
| 4 TIMES | 4 | 4 | | 0.00031 | 2.74E-07 | 3 | 0.000921 |
| 5 TIMES | 5 | 5 | | 1.3E-05 | 1.19E-08 | 10 | 0.000133 |
| 6 TIMES | 6 | 6 | | 3.9E-07 | 3.45E-10 | 20 | 7.74E-06 |
| 7 TIMES | 7 | 7 | | 7.2E-09 | 6.43E-12 | 50 | 3.6E-07 |
| 8 TIMES | 8 | 8 | | 7.8E-11 | 6.99E-14 | 80 | 6.27E-09 |
| 9 TIMES | 9 | 9 | | 3.8E-13 | 3.38E-16 | 100 | 3.79E-11 |
| | | | | | | | 0.010477 | 0.01048 |
| | | | | | | | | 0.92948 |
| | | | | | | WINNING %: | 92.95 |

*FIG. 6G*

VIDEO GAMING MACHINE

This is a continuation of application Ser. No. 07/992,962 filed Dec. 16, 1992 U.S. Pat. No. 5,393,061.

FIELD OF THE INVENTION

The present invention relates to gaming machines and in particular to video gaming machines such as video slot machines and the like which comply with regulatory requirements for video gaming in legal jurisdictions and are government sanctioned. Video gaming machine of this type are considered "legal" within the context of the present application.

BACKGROUND OF THE INVENTION

Video gaming machines are well known in the art and can be found in casinos and other gambling houses throughout North America. Unlike conventional gaming machines which are mechanical in nature and pay out in negotiable currency in the event of a displayed winning combination of game elements, video gaming machines are microprocessor-based and pay out either in the form of credits accumulated in the machine or in negotiable currency, in the event of such a combination of game elements. Credits accumulated in the machine can be redeemed by a player for negotiable currency.

One common type of video gaming machine is in the form of a video slot machine. Similar to the well known mechanical versions, a video slot machine has a display screen on which a simulation of the three spinning wheels of the slot machine is presented. Each simulated wheel is divided into a number of cells with each cell having a game element such as a "cherry", an "orange", a "bar", etc. in it. Different cells of a simulated wheel may have the same element therein and this determines the probability of a particular game element appearing in the display after the wheels have been "spun". Stored in the video slot machine are pay-out tables which assign a pay-out value to predetermined combinations of game elements considered to be winning combinations of game elements that may appear on the screen during a game play. When one or more of these pre-determined combinations of winning game elements stored in the pay-out tables appears on the screen during a game play, the video slot machine multiplies the pay-out value associated with that combination of game elements by the amount bet to determine the number of credits won by the player.

In order to make the video slot machine more exciting to play, the number of pay-out tables and the number of pre-determined combinations of game elements in the pay-out tables (or in other words, the number of ways a player can win) are increased. However, when this is done, the profitability of the video slot machine decreases due to an increase in the expected return of the video slot machine. The expected return of the video slot machine is determined by multiplying the pay-out value assigned to each pre-determined combination of game elements stored in the pay-out tables by the probability of that combination of game elements occurring and then adding each of the calculated products.

For a video slot machine owner to make money, the expected return of the video slot machine should be less than one. In other words, the video slot machine must pay out less money than it takes in. This is easily achieved by maintaining the number of pre-determined winning combinations of game elements stored in the pay-out tables and the pay-out values associated with these combinations of game elements low. However, when this is done, the video slot machine loses its appeal to players since it reduces the occurrence of a player winning during game play. This of course reduces significantly the profitability of the video machine especially if it is rarely used by players. Therefore, in order to maintain the interest of a player for extended periods of time, the video slot machine must have a significant expected return and must present winning combinations of game elements during game play fairly often.

In an attempt to achieve the above, it is current practice to increase the number of pre-determined combinations of game elements stored in the pay-out tables and the pay-out values associated with them to the point where the expected return of the video slot machine far exceeds one. To ensure that the actual pay out of the video slot machine is less than one, the machine is "fixed" using a governor. The governor ensures that the selection of game elements displayed on the screen after a "spin" is not always random. In particular, after a certain number of pay outs have occurred, the selection of game elements displayed on the screen is pre-determined by the governor for a fixed number of following "spins" and is such so that no winning combinations of game elements will be displayed during these following "spins".

Although this results in a video slot machine that pays out less than it takes in, even though the expected return of the machine is greater than one, machines of this type cannot be used in "legal" gambling houses that are government sanctioned. Also, the operation of the governor, which ensures that a fixed number of "spins" will result in no winning combinations of game elements, detracts significantly from the video slot machine's appeal to a player. This is a serious drawback as the more appeal a video slot machine has to a player, the more he/she will play it and therefore, the more money the machine will generate for the video slot machine owner. Heretofore, a video slot machine which did not suffer from the above-identified drawbacks and which complied with regulatory requirements was not available.

It is therefore an object of the present invention to provide a novel video gaming machine.

SUMMARY OF THE INVENTION

According to one aspect of the present invention there is provided a video gaming machine comprising:

a housing having a display on which an array of generally randomly selected game elements are displayed during a game play;

random selection means for selecting generally at random the game elements to be displayed;

a plurality of pay-out tables storing winning combinations of game elements which can appear on said display and a pay-out value associated with each of said winning combinations of game elements, the pay-out values and the winning combinations of game elements in said pay-out tables being chosen so that the expected return of said machine is significant and so that the actual return of the machine is equal to or greater than the expected return of said machine;

pay-out detection means examining said army and said pay-out tables and determining when a combination of game elements displayed in said array is a winning combination of game elements; and means for paying out to a player when a winning combination of game elements appears in said array, the pay-out to said player being based on said pay-out value associated with the winning combination of game elements as displayed and the amount bet by said player.

Preferably, a plurality of winning combinations of game elements may appear on the display during a game play with the pay-out means paying out to a player for each winning combination of game elements appearing on the display. It is also preferred that at least some of the pre-determined combinations of game elements appear in more than one of the pay-out tables. It is also preferred that the pay-out tables are selected so that the expected return of the machine is greater than 0.8 and that the hit ratio of the machine is between 40% and 50%.

Preferably, one of the pay-out tables is associated with bonus credits and that pay-outs from the one pay-out table are accumulated separately as bonus credits and are not paid out directly to a player. Pay out of the bonus credits occurs when a combination of game elements stored in another pay-out table is displayed. Preferably, another of the pay-out tables is associated with a special mode of play and pay outs from this table are only made when the machine has entered the special mode of play. The special mode of play is entered when a particular arrangement of a specific game element is displayed.

The present invention provides advantages in that the actual return of the video gaming machine is less than one without the use of a governor to meet legalized gambling regulations while ensuring that the game is exciting to play. This is achieved by providing a plurality of pay-out tables wherein pay-outs from more than one pay-out table may occur in a single game play and ensuring that the return from the various pay-out tables varies.

BRIEF DESCRIPTION OF THE DRAWINGS

An embodiment of the present invention will now be described more fully with reference to the accompanying drawings in which:

FIGS. 4*a* to 4*e* are pay-out tables stored in the machine illustrated in FIG. 1;

FIGS. 6*a* to 6*g* illustrate the expected returns of the pay-out tables shown in FIGS. 4*a* to 4*e*.

DESCRIPTION OF THE PREFERRED EMBODIMENTS

Figure 1:
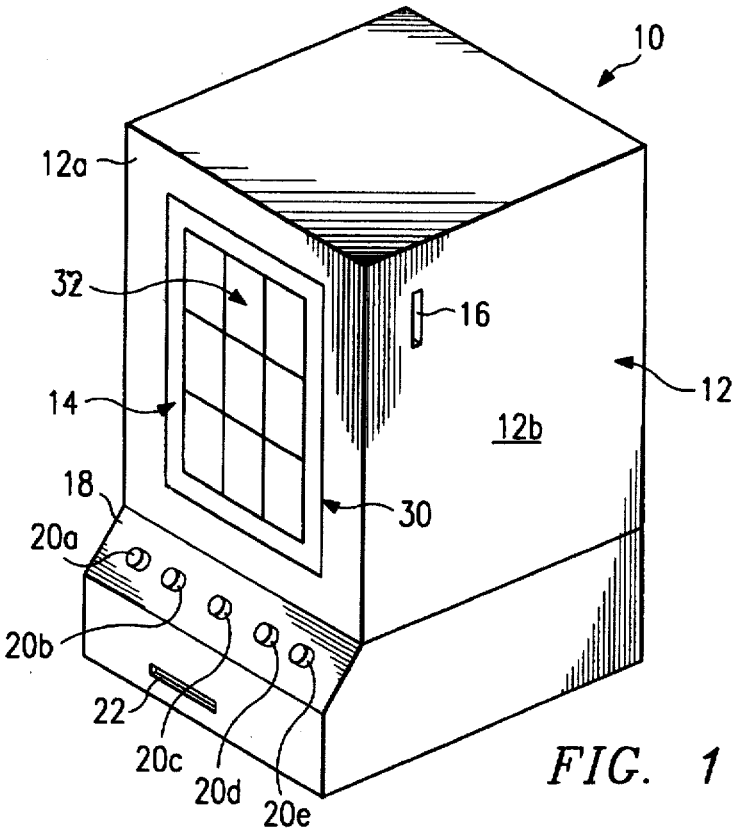
FIG. 1 is a perspective view of a video gaming machine.

Referring now to FIG. 1, a "legal" video gaming machine in the form of a video slot machine is illustrated and is generally indicated by reference numeral 10. The machine 10 includes a housing 12 having a display screen 14 predominantly located on the front face 12*a* of the housing. A money receptacle 16 is located on one side 12*b* of the housing 12 to receive coins deposited therein by a player so that credits to play the machine 10 can be purchased. Below the display screen 14 is an outwardly angled shelf 18 on which a plurality of buttons 20*a* to 20*e* are located. Each of the buttons 20*a* to 20*e* respectively is associated with a specific function such as start game play, bet, spin wheels, stop wheels and terminate game play. By pressing appropriate buttons after at least one credit has been purchased, the video slot machine 10 can be played. A dispensing slot 22 is located below the shelf 18 and allows receipts to be dispensed from the housing 12. Credits accumulated in the machine 10 are printed on the receipts before they are dispensed so that a player may redeem purchased and/or accumulated credits for negotiable currency. Although not shown, the machine 10 also includes a sound board and outputs audio information in the form of "tunes", "bells" etc. during game play.

Within the housing 12 is located a microprocessor-based circuit (not shown) which includes appropriate ROM, RAM, a video controller and a microprocessor together with other circuitry and components necessary to operate the video slot machine 10. Circuits of this type are well known to those of skill in the video gaming machine art and therefore will not be discussed herein.

The microprocessor-based circuit performs a variety of functions necessary to control the operation of the video slot machine 10. In particular, the microprocessor-based circuit monitors the money receptacle 16 to determine the amount of money inserted into machine 10 to purchase credits and adjusts the credit total accordingly. A bin (not shown) is located below the coin receptacle 16 to collect money deposited in the housing 12. A printing and dispensing mechanism is in communication with the microprocessor-based circuit and prints the accumulated credits on a receipt and dispenses the receipt when the button 20 associated with terminating game play is pressed by a player. If this button 20 is pushed by a player, the microprocessor-based circuit requests the player to confirm that it is the player's intent to terminate game play via information displayed on the screen 14 so that accidental use of the terminate game play button 20 does not automatically result in the termination of the game. When game play is terminated and the receipt has been dispensed, the microprocessor-based circuit zeros the credit total.

When the machine 10 is not being used and the credit total therein is zero, the microprocessor-based circuit controls the output of the display screen 14 in accordance with pre-programmed information stored in the microprocessor-based circuit's memory. The output of the screen display simulates game play and in this mode is designed to attract players to the machine. However, when a positive credit total exists in the machine 10, the microprocessor-based circuit monitors the buttons 20*a* to 20*e* and alters the screen display 14 depending on the buttons pushed. This aspect of the microprocessor-based circuit operation will now be discussed.

Figure 2:
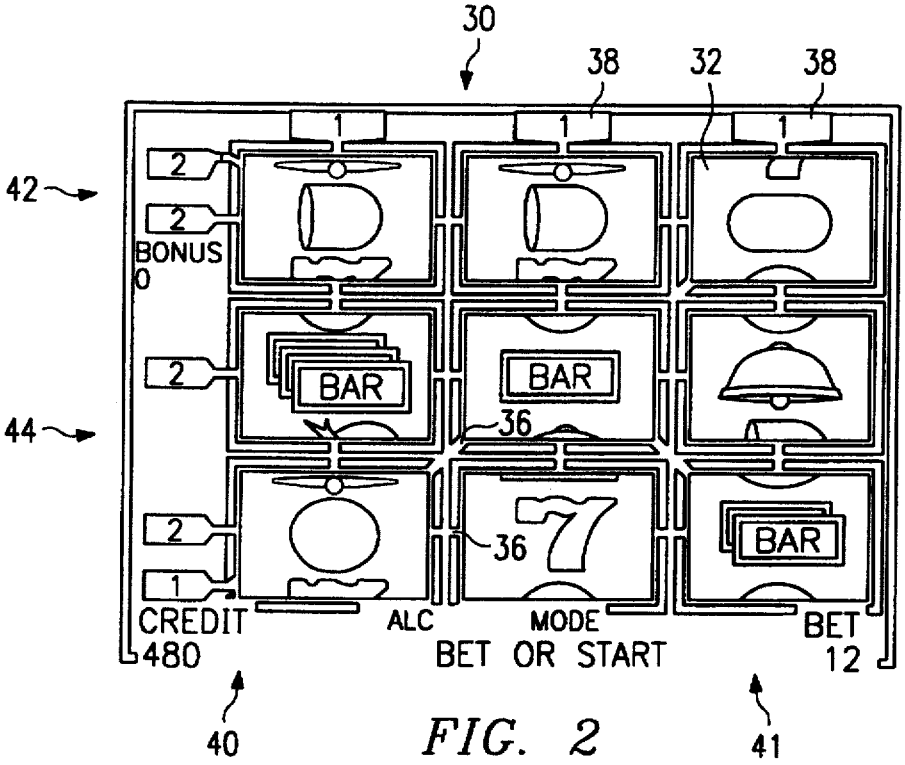
FIG. 2 is an enlarged front view of the display screen on the machine illustrated in FIG. 1 in one mode of operation.

Referring now to FIG. 2, the display screen 14 is better illustrated. As can be seen, the display screen 14 in response to the output of the microprocessor-based circuit presents a 3×3 array 30 of cells 32. Each cell 32 displays one game element selected randomly from an associated look-up table 34 (see FIG. 3) stored in the microprocessor-based circuit's ROM. Each of the nine look-up tables 34 is identical and holds the integer values (RN) 1 to 24. Assigned to each integer value RN is a game element selected from a group of nine pre-determined game elements. These pre-determined game elements resemble typical slot machine objects such as "bars", "oranges", "cherries" etc. Some of the nine game elements appear in the look-up table 34 more than once while others show up only once. In this particular example, the game element resembling an "orange" appears five times in the look-up table, the game elements resembling, "sevens" and "bells" appear four times in the look-up table, the game elements resembling "plums" and "melons" appear three times in the look-up table, the game elements resembling "one bar" and "double bar" appear twice in the look-up table while the game elements resembling "cherries" and "triple bar" appear only once in the look-up table.

Pay-out lines 36 extend across the cells constituting the rows, columns and diagonals of the array 30 and represent some of the pre-determined sets of cells which are examined by the microprocessor-based circuit during game play to determine if a winning combination of game elements is displayed on the screen 14. In this particular example, eight pay-out lines 36 are provided. Tags 38 are located at one end of each pay-out line 36 and display the amount of credits bet by a player on the pay-out line associated therewith. In addition to the cells 32 located on each pay-out line 36, the four corner cells of the array 30 are examined to determine if a winning combination of game elements occurs therein. Also, the entire array of cells is examined to determine the number of cells which display preselected game elements during a game play.

Below the array 30, the display screen 14 shows the credit total 40 accumulated in the machine 10 and the total number of credits bet 41 for each game play. The total bet 41 is equal to the sum of all of the bets displayed in the tags 38. Along one side of the array of cells 32, the display screen 14 shows a bonus credit total 42 accumulated during game play together with an indicator area 44. The indicator area 44 changes colour and provides special mode information if the game advances into a special mode of play coined "Swinging Bells". The accumulation of bonus credits and the requirements to advance into the "Swinging Bells" mode will be discussed further hereinafter.

Pay-out tables 50 are stored in the ROM of the microprocessor-based circuit and are best illustrated in FIGS. 4*a* to 4*e*. As can be seen, the pay-out tables 50 determine the pre-determined sets of cells 32 in the array 30 which are examined during each game play to determine if a win has occurred. The pay-out tables 50 hold the combinations of game elements which must appear in the pre-determined sets of cells in order for a win to occur along with the pay-out value associated with these winning combinations of game elements.

In particular, FIG. 4*a* shows a normal odds pay-out table 60 associated with the cells 32 in the army 30 located along each of the pay-out lines 36. When one of the combinations of game elements stored in the normal odds pay-out table 60 is displayed in the cells 32 along any one of the pay-out lines 36 and a bet has been placed on that pay-out line, the machine 10 pays out to the player and advances the credit total 40 by the appropriate amount. This amount is calculated by multiplying the amount bet on the pay-out line 36 by the pay-out value associated with the winning combination of displayed game elements. If a winning combination of game elements occurs along more than one of the pay-out lines, the machine 10 pays out to the player for each winning combination of game elements provided a bet was placed on the pay-out line 36 on which the winning combination of game elements appeared.

FIG. 4*b* shows a special odds pay-out table 62. Pay outs from this pay-out table only occur if all nine cells 32 in the array 30 or if the four corner cells in the array 30 display the same game element. This pay-out table is not used as a substitute for the pay-out table 60 shown in FIG. 4*a* but rather in addition to it. Therefore, for example if the array 30: of cells displays nine "cherries" during a game play, the microprocessor-based circuit would pay out to the player from normal odds pay-out table 60 for the three "cherries" displayed in the cells 32 along each of the pay-out lines 36 on which a bet was placed, as well as from the special odds pay-out table 62 for the nine "cherries" displayed. The pay out from the special odds pay-out table 62 is determined by multiplying the pay-out value associated with the winning combination of displayed elements by the total current bet 41.

FIG. 4*c* shows a seven odds pay-out table 64 that is associated with the game element "seven". The microprocessor-based circuit pays out from this pay-out table only if two or more of the cells 32 in the array 30 display the element "seven" during a game play. The jackpot occurs when all nine cells 32 display the element "seven". When the jackpot occurs, the microprocessor-based circuit pays out from the seven odds pay-out table 64 for the nine "sevens", from the special odds pay-out table 62 for the "sevens" located in the four corner cells 32 of the array and from the normal odds pay-out table 60 for the three "sevens" located along each of the pay-out lines 36 on which a bet was placed. The pay out from the seven odds pay-out table 64 is determined by multiplying the pay-out value associated with the winning combination of displayed game elements by the total current bet 41.

FIG. 4*e* is similar to FIG. 4*c* and shows a pot odds pay-out table 66 associated with the game element "triple bar". The microprocessor-based circuit only pays out from this pay-out table when the element "triple bar" appears in three or more of the cells 32 in the array 30 during a game play. The pay out from the pot odds pay-out table 64 is similarly determined by multiplying the pay-out value associated with the winning combination of displayed game elements by the current total bet 41. However, when a winning combination of elements from this pay-out table appears on the display 14, the microprocessor-based circuit does not advance the credit total 40 by the amount won but rather advances the bonus credit total 42 by the amount won. It should be realized however, that the microprocessor-based circuit pays out from the normal odds pay-out table 60 if a winning combination of "triple bars" occurs along a pay-out line 36 on which a bet was placed and advances the credit total 40 accordingly.

The accumulated bonus credit total 42 is awarded to a player only when the "all fruit" winning combination of game elements held in the seven odds pay-out table 64 is displayed in the cells 32 of the array during a game play. When this occurs, the bonus credit total 42 is added to the credit total 40 and the bonus credit total is zeroed. The microprocessor-based circuit does not allow the bonus credit total to exceed a pre-determined value; however, the bonus credit total 42 stays in the machine 10 until a player wins it.

Unlike conventional video slot machines having a bonus credit total wherein an advance of bonus credits is determined by multiplying the total bet by a fixed value in the event of a winning combination of game elements, the paying out of bonus credits in the present machine 10 is progressive due to the pot odds pay-out table. Therefore, the number of credits paid into the bonus credit total changes depending on the displayed game elements. The hit ratio associated with the "all fruit" combination of game elements is maintained at a relatively low percentage so that the winning cycle for bonus credits is longer than wins from the above described pay-out tables. Because of this, the bonus credit total 42 establishes a short term goal for a player of the machine 10 and this together with the fact that bonus credit pay outs are progressive, increase the video slot machine's appeal to a player.

Figures 3, 5:
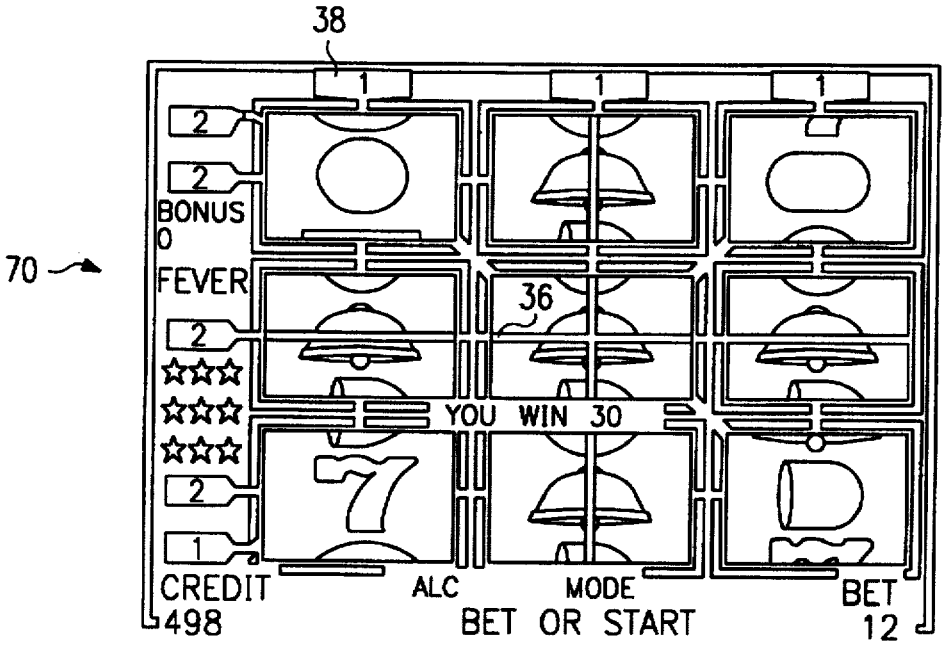
FIG. 3 is a look-up table stored in the machine illustrated in FIG. 1.
FIG. 5 is an enlarged front view of the display screen on the machine illustrated in FIG. 1 in another mode of operation.

FIG. 4*d* shows a pay-out table 68 that is associated with the game element resembling a "bell". The microprocessor-based circuit only pays out from this pay-out table when the machine 10 has entered the "Swinging Bells" mode and the element "bell" is displayed in one or more of the cells 32 in the array. To enter this mode, during game play, the array 30 must display "bells" in the cells 32 along the center row and the center column (ie. in the form of a cross) and this is shown in FIG. 5. In the "Swinging Bells" mode, the display colours are enhanced by the microprocessor-based circuit and the "bells" in the cells 32 are enlarged. During a game play in this mode, when a "bell" appears in a cell 32, the "bell" swings back and forth on the screen 14, and the audio of the game changes and rings in time with the swinging motion of the bell or bells. Also, the audio output of the machine 10 increases as the number of displayed "bells" increases. The enhanced colours and the increased activity presented on the screen 14 have significant phycological effects which increase the video slot machine's appeal to a player.

It should be apparent that when the machine 10 is in the "Swinging Bells" mode, payouts from the other pay-out tables are made if a winning combination of game elements stored in these tables appears on the screen 14 during a game play.

Once the game has entered the "Swinging Bells" mode, it remains in the mode for a total of nine wheel "spins" or game plays. The number of spins remaining in the mode are shown in the indicator area 44 as stars 70. During the "Swinging Bells" mode, the total bet 41 on a game play cannot be raised over what it was in the game play just before the "Swinging Bells" mode was entered. Similar to the other pay-out tables 62 to 66, the microprocessor-based circuit pays out from the pay-out table 68 by multiplying the pay-out value associated with the winning combination of elements by the total bet 41. After the nine spins, the machine reverts back to normal operation until a game play results in the "bells" being displayed in the array 32 in the form of a cross.

Different from the bonus credit total 42, the "Swinging Bells" mode creates a long term goal for the player of the video slot machine 10. This is achieved by ensuring that the hit ratio associated with "bells" appearing in the form of a cross is at a lower percentage than that of the "all fruit" combination of game elements. Thus, the winning cycle for pay outs in the "Swinging Bells" mode is even longer than pay outs of bonus credits. This in combination with the bonus credit total further enhances the appeal of the video slot machine to a player as it creates greater dynamics. This longer winning cycles for these goals helps to prevent players from cashing out before all of the accumulated credits have been used and therefore increases the profitability of the machine.

The combination of the nine game elements forming the twenty-four elements in the look-up tables 34, the combinations of game elements which result in a win and the pay-out values assigned to each of the winning combinations of game elements are selected to ensure that the machine 10 complies with regulatory requirements to be considered "legal". Within the meaning of this specification, "legal" means that the video slot machine 10 is statistically balanced within its environment and has an expected return equal to or slightly less than its actual return. This is very different from prior art video slot machines which make use of a governor to "fix" the machine to ensure that the actual return of the machine is less than its expected return.

In addition, the design of the pay-out tables in the present video slot machine, is selected to ensure that the expected return of the machine is below one but is still significant. By significant, it is meant that the video slot machine 10 has an expected return equal to or greater than 0.8. Not only that, the pay-out tables are selected so that the hit ratio of the video slot machine 10 is also significant and is between 0.4 and 0.5. As is known to those of skill in the art, hit ratio refers to the percentage that a game play will result in a combination of game elements being displayed in the array of cells 32 considered to be a winning combination of game elements and therefore results in a pay out to the player. It should be realized that this does not mean that the pay out will always be more than the amount bet by the player, which may occur, but may also represent a pay out which is only a portion of the amount bet.

FIGS. 6*a* to 6*g* illustrate the expected return of the individual pay-out tables shown in FIGS. 4*a* to 4*e* used in the video slot machine 10. In each Figure, the probability of each winning combination of game elements occurring is given. To determine the expected return, the probability is multiplied by the pay-out value assigned to that winning combination of game elements. The expected return of the video slot machine 10 is the total of all of the products and in this case is equal to approximately 0.9295. This means that a player can expect to win back 92.95% of the money wagered if the machine 10 is played continuously.

In general, the expected return of the machine 10 can be calculated using the formula:

$$P(A_1)*V_1+P(A_2)*V_2+\ldots+P(A_n)*V_n$$

where $A_i$ represents a winning combination of game elements storm in a pay-out table, $V_i$ is the pay-out value associated with the winning combination of game elements $A_i$ and P is the probability of the winning combination of game elements $A_i$ occurring. The probability of each winning combination of game elements $A_i$ of the video slot machine 10 is calculated using statistical analysis.

The operation of the video slot machine 10 will now be described with reference to the Figures. When money is deposited into the machine 10 via the coin slot 16, the microprocessor-based circuit detects this and increments the credit total 40 to a value dependant on the total amount of money deposited into the machine. To play the video slot machine, once at least one credit has been purchased, the player must press the button 20 associated with initiating game play and this causes the microprocessor-based circuit to prompt the user to depress the button 20 associated with betting. Using the button, the player can assign appropriate bets to any or all of the pay-out lines 36. The amount bet on each pay-out line 36 is displayed in the tags 38 and is subtracted from the credit total 40. The sum of the individual bets shown in the tags 38 is displayed as the total current bet 41. After this, the player is prompted to press the button associated with "spinning" the wheels and once this is done, the microprocessor-based circuit conditions the display screen 14 to simulate the spinning wheels of a slot machine. The spinning wheel simulation appears in each of the nine cells 32.

As the wheels are "spinning", the microprocessor-based circuit executes a random number generation program to generate an integer having a value between one and twenty four. The initial values used by the microprocessor-based circuit to generate the random numbers are read from the registers of a real time clock in the microprocessor-based circuit to prevent the random number generation program from starting at the same place in the sequence after the video slot machine 10 has been powered up. The random number generation program is executed nine times during each game play resulting in nine numbers being generated. Each random number RN is associated with one of the cells 32 in the array. Once a pre-determined amount of time has elapsed after the wheels have been "spun", the microprocessor-based circuit uses the generated random numbers and the look-up tables 34 to select the nine game elements to be displayed in the cells 32. For example, if the random number generation program when executed resulted in a value equal to "6", the game element "orange" would appear in the cell 32 associated with that value. Likewise, if the value "10" were generated by the program, the game element "double bar" would appear in the cell 32 associated with that value.

If the player presses the button 20 associated with stopping the wheels while the wheels are "spinning", the microprocessor-based circuit stops the spinning wheel simulation immediately and displays the game elements associated with the generated random numbers in the cells 32 of the array 30.

Once each of the nine cells 32 displays a game element, the microprocessor-based circuit examines the combinations of displayed game elements in the cells 32 located along each pay-out line 36 on which the player has placed a bet and compares the displayed game elements with the combinations of game elements stored in the normal odds pay-out table 60 to determine if a win has occurred. The microprocessor-based circuit also examines the other pre-determined sets of cells (i.e.: the entire array 30 and the four corner cells 32) to determine if a win has occurred in the other pay-out tables. If a winning combination of game elements occurs, the microprocessor-based circuit calculates the credits won from each pay-out table and computes the total credits won during that game play. The microprocessor-based circuit then conditions the screen to show the total credits won and advances the credit total 40 accordingly for pay outs from pay-out tables 60 to 64 and 68 and advances the bonus credit total 42 for pay outs from pay-out table 66.

As long as the credit total 40 in the machine 10 is above zero, a player can continue to play. After one game play, if the player does not enter new bets in the tags 38 for the following game play, the microprocessor-based circuit uses the bets made during the previous game. The player can play until the credit total 40 goes to zero in which case more money needs to be deposited into the machine 10 to continue play. When this occurs, the machine 10 notifies the player and gives the player a pre-determined amount of time to deposit more money. If the player fails to deposit more money, the microprocessor-based circuit goes into the attract mode and conditions the screen output in accordance with preprogrammed information therein.

Alternatively, the player can cash out the accumulated credit total 40 and redeem the credit total for negotiable currency. If this option is selected, the machine 10 prints the credit total 40 on a receipt and dispenses the receipt through the slot 22. The microprocessor-based circuit then clears the credit total to zero. The microprocessor-based circuit also prints and dispenses a receipt and clears the credit total when the credit total exceeds a predetermined value.

Appendix A shows the results of 51 million game plays executed on the video gaming machine 10 having look-up tables and pay-out tables the same as those illustrated in FIGS. 3 and 4*a* to 4*e*. As can be seen, the machine exhibited an actual return equal to approximately 0.9298 after this many plays. Of significance is the fact that the actual return of the machine is more or less equal to its expected return achieving what prior art machines do without the aid of a governor. Because a governor is not used in the present machine, it can be used in "legal" gaming environments.

Also of significance is the hit ratio achieved by the present machine. As mentioned previously, the hit ratio represents the percentage of time a winning combination of game elements will be displayed. In this case, the machine will display a winning combination of game elements in almost 50% of all game plays. The high hit ratio makes the game particularly appealing to players as they can almost expect to win at least something every other game play.

The present invention provides significant advantages over the prior art in that it is extremely appealing to players and yet is suitable for use in legal gambling environments. This is achieved by constructing multiple pay-out tables which ensure that the actual return of the machine 10 is greater than or equal to the expected return, and that the hit ratio is significant. In other words, the present invention includes all of the features of "illegal" machines designed to attract players but implements these features in a "legal" machine.

Although, the video slot machine 10 has been described as using buttons 20 to control operation of the machine, touch screen technology can be implemented to replace the buttons. If this is done, a player need only touch selected areas of the display screen 14 to chose different functions. The machine can also incorporate both the buttons and a touch screen allowing players to chose the manner in which they wish to operate the machine.

Also, rather than dispensing printed receipts in the event of a win, the video slot machine 10 can include a coin bin instead of receipt dispensing slot 22 and dispense coins in the event of a win. The machine can also incorporate both the coin bin and the dispensing slot 22 allowing a player to select the form in which accumulated credits in the machine are to be redeemed.

APPENDIX A

TOTAL NUMBER OF GAMES PLAYED: 51000000
TOTAL NUMBER OF GAMES WITH A WIN: 24014085.00000000

HIT RATIO PERCENTAGE: 47.08644%
TOTAL CREDITS WON: 1209241875.000000
TOTAL CREDITS PLAYED: 1300594080.000000

WINNING PERCENTAGE: 92.97612%

TOTAL WIN NORMAL ODDS: 352997337.0000000
NORMAL ODDS %: 27.14123817940183

TOTAL WIN SPECIAL ODDS: 49875380.00000000
SPECIAL ODDS %: 3.834815240739832

TOTAL WIN SEVEN ODDS: 771535218.0000000
SEVEN ODDS %: 59.32175379423532

TOTAL SWINGING BELLS: 6584.000000000000
SWINGING BELL HIT RATIO: 1.2909804E−02%
TOTAL GAMES PLAYED IN FEVER MODE: 59256.00000000000
TOTAL WIN BELLS ODDS: 34833940.00000000
BELLS ODDS %: 2.678309899734435

TOTAL CREDITS ACCUMULATED IN POT: 13625504.00000000
CURRENT CREDITS IN POT: 306.0000000000000
HIGHEST CREDITS IN POT: 3632.000000000000
TOTAL CREDITS WON FROM POT: 13625198.00000000
AVERAGE POT SIZE IN CREDITS: 302.0371
WINNING PERCENTAGE FROM POT: 1.047613%

TOTAL WIN DOUBLE UP: 0.0000000000000000E+00
DOUBLE UP %: 0.0000000E+00%

$$$$$ NORMAL ODDS $$$$$

| ELEMENTS | ODDS | FREQUENCY |
|---|---|---|
| TRIPLE BAR: | 50 | 29374 |
| DOUBLE BAR: | 25 | 235988 |
| SINGLE BAR: | 15 | 235622 |
| MELON: | 12 | 235747 |
| BELL: | 10 | 1889120 |

APPENDIX A-continued

| | | |
|---|---|---|
| SEVEN: | 10 | 1889385 |
| PLUM: | 8 | 797573 |
| ORANGE: | 5 | 3686855 |
| ANY BAR: | 5 | 3186042 |
| CHERRY: | 5 | 29255 |
| TWO CHERRY: | 3 | 678346 |
| ONE CHERRY: | 1 | 51062368 |

$$$$$ SPECIAL ODDS $$$$$

| ELEMENTS | ODDS | FREQUENCY |
|---|---|---|
| ALL TRIPLE BAR: | 150 | 0 |
| ALL DOUBLE BAR: | 120 | 0 |
| ALL CHERRY: | 110 | 0 |
| ALL SINGLE BAR: | 100 | 0 |
| ALL MELON: | 90 | 0 |
| ALL BELL: | 80 | 5 |
| ALL PLUM: | 70 | 0 |
| ALL ORANGE: | 60 | 38 |
| ALL ANY BAR: | 50 | 47 |
| FOUR CORNERS: | 10 | 194696 |

$$$$$ SEVEN ODDS $$$$$

| COMBINATION | ODDS | FREQUENCY |
|---|---|---|
| 9 SEVENS: | 380 | 2 |
| 8 SEVENS: | 200 | 255 |
| 7 SEVENS: | 100 | 4479 |
| 6 SEVENS: | 20 | 53365 |
| 5 SEVENS: | 10 | 398541 |
| 4 SEVENS: | 5 | 1993095 |
| 3 SEVENS: | 2 | 6638886 |
| 2 SEVENS: | 0 | 14236266 |
| ALL FRUITS: | 20 | 45111 |

$$$$$ BELLS ODDS (IN FEVER MODE) $$$$$

| COMBINATION | ODDS | FREQUENCY |
|---|---|---|
| 9 BELLS: | 100 | 0 |
| 8 BELLS: | 90 | 0 |
| 7 BELLS: | 80 | 11 |
| 6 BELLS: | 70 | 61 |
| 5 BELLS: | 60 | 474 |
| 4 BELLS: | 50 | 2273 |
| 3 BELLS: | 40 | 7776 |
| 2 BELLS: | 30 | 16457 |
| 1 BELLS: | 20 | 20694 |

$$$$$ POT ODDS $$$$$

POT ELEMENT: 3

| COMBINATION | ODDS | FREQUENCY |
|---|---|---|
| 9 ELEMENTS: | 100 | 0 |
| 8 ELEMENTS: | 80 | 0 |
| 7 ELEMENTS: | 50 | 0 |
| 6 ELEMENTS: | 20 | 20 |
| 5 ELEMENTS: | 10 | 680 |
| 4 ELEMENTS: | 3 | 15595 |
| 3 ELEMENTS: | 2 | 239976 |
| 2 ELEMENTS: | 0 | 2368192 |
| 1 ELEMENT: | 0 | 13605149 |

```
$$$$$$$$$$$$$$$$$$$$$$$$
$$                  $$
$$   JACKPOT      $$:      2

$$                  $$
$$$$$$$$$$$$$$$$$$$$$$$$
```

We claim:

1. A video gaming machine comprising:

a housing having a display on which an array of generally randomly selected game elements are displayed during a game play;

random selection means for selecting generally at random the game elements to be displayed;

a game element table storing a list of the game elements for selection, the probability of selection of some of the game elements being greater than the probability of selection of other of said game elements;

a plurality of pay-out tables storing winning combinations of game elements which can appear on said display and a pay-out value associated with each of said winning combinations of game elements, the pay-out values and the winning combinations of game elements in said pay-out tables being chosen so that the expected return of said machine is significant and so that the actual return of the machine is approximately the same as the expected return of said machine;

pay-out detection means examining said array and said pay-out tables and determining when a combination of game elements displayed in said array is a winning combination of game elements; and means for paying out to a player when a winning combination of game elements appears in said array, the pay-out to said player being based on said pay-out value associated with the winning combination of game elements as displayed and the amount bet by said player.

2. A video gaming machine as defined in claim 1 wherein a plurality of winning combinations of game elements may appear on said display during a game play, said pay-out means paying out to said player for each winning combination of game elements appearing on said display.

3. A video gaming machine as defined in claim 2 wherein the actual return of said video gaming machine is approximately equal to the expected return of said video gaming machine.

4. A video gaming machine as defined in claim 3 wherein at least some of said winning combinations of game elements appear in more than one of said pay-out tables.

5. A video gaming machine as defined in claim 4 wherein pay outs from some of said pay-out tables are accumulated separately as bonus credits and are not paid out directly to a player and wherein at least one of said pay-out tables has a combination of game elements therein which results in said bonus credits being paid out to a player.

6. A video gaming machine as defined in claim 5 wherein all pay outs from one of said pay-out tables are accumulated as bonus credits.

7. A video gaming machine as defined in claim 6 wherein only one of said pay-out tables has a combination of game elements therein which results in said bonus credits being paid out to a player.

8. A video gaming machine as defined in claim 2 wherein said pay-out tables are selected so that said machine has an expected return greater than 0.8.

9. A video gaming machine as defined in claim 8 wherein said pay-out tables are selected so that said machine has an expected return equal to at least 0.9.

10. A video gaming machine as defined in claim 8 wherein said pay-out tables are selected so that a winning combination of game elements is displayed approximately between 40% and 50% of all game plays.

11. A video gaming machine as defined in claim 10 wherein said array has at least three rows and three columns and wherein winning combinations of game elements can occur along the rows, columns or diagonals of said array, said machine further including means to permit a player to place a bet on each row, column and diagonal, said pay-out means paying out to a player for each winning combination of game elements appearing in a row, column and diagonal of said array on which a bet was placed during a game play.

12. A video gaming machine as defined in claim 11 wherein one of said pay-out tables holds winning combinations of game elements associated with only said rows, columns and diagonals and wherein the other of said pay-out tables are associated with a particular game element, said payout means paying out to a player from said other pay-out tables when a pre-determined number of said cells display the same particular game element.

13. A gaming machine, comprising:

a housing having a display on which an array of generally randomly selected game elements is displayed during a game play, said array having rows and columns intersecting the rows, each column and row having a plurality of game elements;

a processor coupled to said display, a game element selector of said processor generally randomly selecting each of a set of game elements to be displayed from a plurality of different game elements;

a memory coupled to said processor, a special configuration memory portion of said memory storing a predetermined special configuration of said machine which may occur during a game play;

a pay-out memory portion of said memory storing winning combinations of game elements which can appear in said set of game elements during a game play;

a pay-out detector of said processor comparing said set of game elements with said winning combinations of game elements, said pay-out detector determining when said set of game elements includes a winning combination of game elements, a pay-out value associated with each of said winning combinations of game elements, the pay-out values and the winning combinations of game elements being chosen so that the expected return of the machine is significant and so that the actual return of the machine is approximately the same as the expected return of the machine;

a special configuration detector of said processor determining when said machine is in said special configuration, said processor altering the behavior of the machine for a plurality of subsequent game plays based on the occurrence of the special configuration; and pay-out means for paying out to a player responsive to said pay-out detector detecting when a winning combination of game elements exists in said set of game elements.

14. The gaming machine of claim 13, wherein said special configuration comprises a predetermined configuration of game elements occurring during a game play.

15. The gaming machine of claim 14, wherein said set of game elements has columns and rows, said predetermined special configuration comprises having all of the game elements in a column of said set of elements be of the same kind, and all of the game elements in a row of said set of elements be of the same kind.

16. The gaming machine of claim 15, wherein said set of elements has an odd number of columns including a middle column and odd number of rows including a middle row, said column of said set of game elements being said middle column and said row of said set of game elements being said middle row, such that said predetermined special configuration of game elements comprises a cross.

17. A gaming machine, comprising:

a housing having a display on which an array of generally randomly selected game elements is displayed during a game play;

a processor coupled to said display, a game element selector of said processor generally randomly selecting each of a set of game elements to be displayed;

a memory coupled to said processor, a pay-out memory portion of said memory storing winning combinations of game elements which can appear in said set of game elements and pay-out values associated with respective ones of said winning combinations of game elements, the pay-out values and the winning combinations of game elements being chosen so that the expected return of the machine is significant and so that the actual return of the machine is approximately the same as the expected return of the machine;

a special configuration memory portion of said memory storing a special configuration of the machine which the machine may enter during a game play;

a pay-out detector of said processor comparing said set of game elements with said winning combinations of game elements, said pay-out detector determining when said set of game elements includes a winning combination of game elements;

a special configuration detector of said processor detecting when a current configuration of the machine matches said stored special configuration, said processor altering the behavior of the machine for a plurality of subsequent game plays responsive to detection of the special configuration; and pay-out means for paying out to a player responsive to said pay-out detector detecting when a winning combination of game elements exists in said set of game elements.

18. The gaming machine of claim 17, wherein said processor configures the gaming machine into a special mode of operation upon the occurrence of the special configuration, said pay-out memory portion storing at least one special winning combination of game elements, said pay-out detector comparing said set of game elements to said at least one special winning combination of game elements when said machine is configured into said special mode of operation; and said pay-out means paying out to a player when said at least one special combination of game elements exists in said array only during said special mode of operation.

19. The gaming machine of claim 18, wherein said pay-out memory portion stores a plurality of special winning combinations of game elements, said pay-out detector comparing said set of game elements to each of said plurality of special winning combinations of game elements when the machine is in said special mode of operation, said pay-out means paying out to a player when any of said special winning combinations of game elements exists in said array only during said special mode of operation.

20. The gaming machine of claim 19, wherein each special winning combination of game elements within said plurality of special winning combinations of game elements specifies a predetermined number of a predetermined game element within said set of game elements, the predetermined number of any one of said special winning combinations of game elements being different from the predetermined number of any other of said special winning combinations of game elements.

21. The gaming machine of claim 18, wherein said at least one special combination of game elements comprises a predetermined number of a predetermined game element within said set of game elements to be displayed.

22. The gaming machine of claim 18, wherein said special mode of operation lasts for a predetermined number of game plays.

23. The gaming machine of claim 18, wherein the number of plays left to play in said special mode of operation is indicated on said display.

24. The gaming machine of claim 17, wherein said set of game elements is organized into columns and rows of game elements, said special configuration comprising at least one row and at least one column being occupied by one predetermined kind of game element.

25. The gaming machine of claim 17, wherein said set of game elements has an odd number of rows greater than one and an odd number of columns greater than one, said special configuration comprising a middle column and a middle row being occupied by said one predetermined kind of game element.

26. The gaming machine of claim 17, wherein said special configuration comprises a predetermined configuration of game elements appearing in said set of game elements to be displayed.

27. A gaming machine comprising:

a housing having a display on which an array of generally randomly selected game elements are displayed during a game play, said array having a plurality of rows and a plurality of columns, cells occupied by game elements in the array occupying intersections of the rows and columns, a plurality of pay-out lines associated with respective ones of at least the rows of the array;

a processor including a game element selector for selecting generally at random a set of game elements to be displayed from a plurality of kinds of game elements;

a memory coupled to said processor and including a pay-out memory portion storing a plurality of winning combinations of game elements which can appear on said display, some of said winning combinations of game elements specifying a particular configuration of elements along any pay-out line in said array, others of said winning combinations of game elements specifying that a predetermined number of a predetermined game element be among said set of game elements to be displayed, a pay-out value associated with each of the winning combinations of game elements, the pay-out values and the winning combinations of game elements being so chosen that the expected return of the machine is significant and that the actual return of the machine is approximately the same as the expected return of the machine;

a pay-out detector of said processor comparing said set of game elements to be displayed with said winning combinations of game elements; and pay-out means responsive to said pay-out detector for paying out to a player when a sufficient match exists between a winning combination of game elements and said set of game elements to be displayed.

28. The gaming machine of claim 27, wherein pay-out lines are also associated with each of said columns of said array.

29. The gaming machine of claim 27, wherein pay-out lines are also defined on diagonals of said cells in said array, said diagonals formed at an angle to said rows and columns and each diagonal containing a plurality of said cells.

* * * * *

UNITED STATES PATENT AND TRADEMARK OFFICE

CERTIFICATE OF CORRECTION

PATENT NO. : 5,697,843

DATED : December 16, 1997

INVENTOR(S) : Jon Manship, et al

It is certified that error appears in the above-identified patent and that said Letters Patent is hereby corrected as shown below:

In the Abstract, line 3, delete "army" and insert --array-- .
In the Abstract, line 20, delete "army" and insert --array--.
In Column 5, line 37 , delete "army" and insert --array--.
In Column 5, line 58 , after "30" delete --:--.
In Column 8, line 26 , delete "storm" and insert --stored--.

Signed and Sealed this

Thirty-first Day of March, 1998

Bruce Lehman

*Attest:*

BRUCE LEHMAN

*Attesting Officer*

*Commissioner of Patents and Trademarks*